US005102731A

United States Patent [19]

Takimoto et al.

[11] Patent Number: 5,102,731

[45] Date of Patent: Apr. 7, 1992

[54] RECORDING MEDIUM

[75] Inventors: Hiroshi Takimoto, Yokohama; Tomio Yoneyama; Hideo Sano, both of Kawasaki; Minoru Masuda, Machida, all of Japan

[73] Assignee: Mitsubishi Kasei Corporation, Tokyo, Japan

[21] Appl. No.: 342,875

[22] Filed: Apr. 25, 1989

[30] Foreign Application Priority Data

Apr. 27, 1988 [JP] Japan ..... 63-105090
Oct. 3, 1988 [JP] Japan ..... 63-249568
Nov. 11, 1988 [JP] Japan ..... 63-284861

[51] Int. Cl.[5] ..... B41M 5/00

[52] U.S. Cl. ..... 428/323; 428/195; 428/207; 428/327; 428/328; 428/331; 428/423.1; 428/480; 428/500

[58] Field of Search ..... 346/135.1; 428/195, 428/423.1, 480, 500, 207, 323, 327, 328, 331

[56] References Cited

U.S. PATENT DOCUMENTS 4,642,247 2/1987 Mouri et al. ..... 428/195
4,960,638 10/1990 Mukoyoshi ..... 428/342

FOREIGN PATENT DOCUMENTS 3523269 1/1986 Fed. Rep. of Germany ..... 428/195

*Primary Examiner*—Pamela R. Schwartz
*Attorney, Agent, or Firm*—Oblon, Spivak, McClelland, Maier & Neustadt

[57] ABSTRACT

A recording medium comprising a non-porous substrate and a coating layer formed thereon, said coating layer comprising a carboxyl group-containing ionomer-type hydrophilic urethane resin and organic and/or inorganic fine particles.

42 Claims, No Drawings

RECORDING MEDIUM

The present invention relates to a recording medium. More particularly, it relates to a recording medium for an ink jet printer, which comprises a non-porous substrate and an aqueous ink-receiving layer formed on at least one side of the substrate and being capable of high density recording by e.g. an ink jet printer.

Ink jet printers have been widely used in recent years by virtue of excellent characteristics such as clear recording, less noise and color printing feasibility. For such ink jet printers, hardly driable ink is used to avoid clogging of the jet nozzle. Such ink is usually composed of a binder, a dye and additives dissolved in e.g. water, a polyhydric alcohol, a polyhydric alcohol ether or pyrrolidone.

Therefore, to conduct print-recording by an ink jet printer, the recording sheet is required to have water-absorptivity. It is common to employ paper specially designed to have a property for sufficiently absorbing ink.

On the other hand, reflecting the tendency for color printing by ink jet printers, there has been an increasing demand for recording on a so-called recording medium comprising a non-porous substrate other than paper and an ink-receiving layer formed on at least one surface of the substrate, which will be used as an original sheet for an overhead projector (OHP) or as an interior or exterior article.

Such a recording medium is usually made of a plastic film, a glass sheet, a metal plate or a tile. However, such a plastic film, a glass sheet, a metal plate or a tile is non-porous and hydrophobic, and it does not absorb aqueous ink for an ink jet printer at all. Accordingly, the ink directly recorded thereon does not easily dry up, and when rubbed with a finger or overlaid, the recorded portion smears, and such is not practically useful.

Namely, to obtain recorded images of a high degree of resolution and high quality, the recording medium useful for an ink jet recording system is required to fulfill the following requirements:

1) It readily absorbs the ink,
2) When ink dots overlap one another on the medium, the ink dot applied later should not mix with the ink dots formed earlier.
3) Diameters of ink dots on the medium should not expand more than necessary.
4) Shapes of ink dots on the medium should be substantially true circles, and the outlines thereof should be smooth.
5) Ink dots on the medium should have a high density, and the outlines thereof should not be fuzzy.
6) It provides excellent color development for the ink.

In addition, it is required that the ink-receiving layer is smooth and flat over the entire surface and is free from defects such as coating irregularities which are likely to result when the ink-receiving layer is coated on the non-porous substrate, such as irregularities in the form of streak lines or craters.

To fulfill such requirements, many proposals have been made for a method of coating a certain specific polymer on a plastic film. For example, Japanese Unexamined Patent Publications No. 14,091/1982, No. 11,284/1984, No. 33,179/1984, No. 132,785/1985, No. 145,875/1985, No. 220,750/1985, No. 193,879/1986, No. 21,579/1987 and No. 144,986/1987 may be mentioned.

However, with a rapid progress in the printer technology in recent years, the trend for high density and high speed of recording has been accelerated. Accordingly, the recording media are required to have higher levels of ink drying properties, color development properties, adhesion of the ink-receiving layer to the substrate and smoothness of the ink-receiving layer. However, none of conventional recording media fully satisfy these requirements.

Under these circumstances, it is an object of the present invention to provide a recording medium which fully satisfies the above-mentioned property requirements and is excellent particularly in the ink-absorbing properties, color developing properties, adhesion and smoothness and which is useful not only for observation of the images recorded on the surface but also for observation of the recorded images by means of an optical device such as a slide projector, OHP or a contact-printer, using transmitting lights, as well as for ink jet recording.

The present invention provides a recording medium comprising a non-porous substrate and a coating layer formed thereon, said coating layer comprising a carboxyl group-containing ionomer-type hydrophilic urethane resin and organic and/or inorganic fine particles.

Now, the present invention will be described in detail with reference to the preferred embodiments.

As the non-porous substrate for the recording medium of the present invention, a substrate of a flat shape such as a film, a sheet or a plate may be employed. For example, it may be a film, sheet or plate of a plastic material such as polyester, diacetate, triacetate, acrylate polymer, cellophane, celluloid, polyvinyl chloride, polycarbonate, polyimide or polyamide, a glass sheet, a tile, or a metal plate, preferably a plastic film or sheet, further preferably a sheet of polyvinyl chloride or polyester. The thickness of the substrate is not critical, and a substrate having any thickness may be used depending upon the particular purpose.

The recording medium of the present invention has a coating layer on the above-mentioned non-porous substrate, which coating layer constitutes an ink-receiving layer having affinity to aqueous ink.

Among materials capable of forming such an ink-receiving layer, the ionomer-type hydrophilic urethane resin used in the present invention is preferably the one having a carboxyl group as its ion group and having a molecular weight within a range of from 1,000 to 100,000. The term "molecular weight" as used herein means weight average molecular weight.

Such a urethane resin includes a resin having a polyester urethane backbone prepared by esterifying a dicarboxylic acid with a diol in the presence of an acid or alkaline catalyst, followed by reacting the hydroxyl group remaining at the terminals of the molecule with an aromatic isocyanate, with an aliphatic isocyanate or with an alicyclic isocyanate, and a urethane resin having a polyether urethane backbone which is a reaction product of a polyether diol, an aliphatic monocarboxylic acid having two hydroxyl groups per molecule and an isocyanate.

Such dicarboxylic acid may be, for example, an aliphatic saturated or unsaturated dicarboxylic acid such as adipic acid or maleic acid, or an aromatic dicarboxylic acid such as terephthalic acid.

The diol useful to the polyester urethane includes, for example, ethylene glycol, propylene glycol, butylene glycol, hexanediol, triethylene glycol, hexamethylene glycol, polypropylene glycol, an adduct formed from an alkylene oxide and bisphenol A and an aliphatic diol having a carboxyl group in its molecule which is represented by the formula:

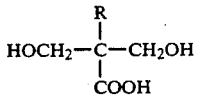

wherein R is an alkyl group having from 1 to 3 carbon atoms.

Typical example is dimethylolpropionic acid.

As the polyether diol, a polyalkylene glycol such as polyethylene glycol or polypropylene glycol may be mentioned. Such a polyether diol preferably has a molecular weight of from 200 to 40,000.

The aliphatic carboxylic acid having two hydroxyl groups per molecule may be a compound of the formula:

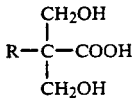

wherein R is an alkyl group having from 1 to 3 carbon atoms. Specifically, dimethylolpropionic acid is mentioned.

The isocyanate useful for the production of both the polyester and polyether urethane resins, may be an aliphatic diisocyanate such as hexamethylene diisocyanate, an alicyclic diisocyanate such as isophorone diisocyanate, or an aromatic diisocyanate such as diphenylmethane diisocyanate, xylene diisocyanate or 2,4- or 2,6-tolylene diisocyanate.

Such an ionomer-type hydrophilic urethane resin preferably has a molecular weight of 1,000 to 100,000.

For the preparation of the above polyester urethane resin, the dicarboxylic acid is esterified with the diol in a molar ratio to the diol of 5/5 to 2/8 as the feeding ratio. The rate of esterification of the carboxyl groups is preferably within a range of from 50 to 95%. This ester is reacted with the isocyanate so that the molar ratio of the isocyanate groups of the isocyanate to the hydroxyl groups of the ester is within a range of from 5/5 to 3/7.

On the other hand, the above polyether urethane resin is the reaction products of the polyether diol, the aliphatic monocarboxylic acid such as dimethylolpropionic acid and the isocyanate. A molar ratio of the polyether diol to said carboxylic acid is from 1/9 to 9/1 as the feeding ratio. The isocyanate is used so that the molar ratio of the isocyanate groups of the isocyanate to the total hydroxyl groups of said polyetherdiol and the said carboxylic acid is within a range of from 5/5 to 3/7.

These ionomer type hydrophilic urethane resins can be produced by conventional methods. Specifically, they may be prepared by methods disclosed, for example, in Japanese Unexamined Patent Publications No. 36314/1986, No. 15816/1988, No. 270613/1987, No. 39911/1988 and No. 270614/1987. The above-mentioned ionomer type hydrophilic urethane resin may be selected from commercially available products.

This resin is commercially available usually in the form of a water solution or a water dispersion. Such a solution preferably has a viscosity of not higher than 600 cps at 25° C. Particularly preferred is the one having a pH within a range of from 6 to 9.

As a commercial product, for example, Hydran (tradename) manufactured by Dainippon Ink and Chemicals Inc. and Superflex (tradename) manufactured by Dai-ichi Kogyo Seiyaku Co., Ltd. may be mentioned. Particularly preferred is, for example, polyester-type Hydran HW-310, 40 or AP-30 and polyester Superflex 100 or 300.

Such ionomer type hydrophilic urethane resin is used preferably in an amount of from 40 to 60% by weight based on the dry weight of the coating layer.

As the organic fine particles incorporated in the coating layer of the recording medium of the present invention, fine particles of e.g. polystyrene, polyethylene, polyethylene urea or urea-formaldehyde resin, may be mentioned. Particularly preferred is the urea-formaldehyde resin, in view of the absorptivity of the ink.

Such organic fine particles may have a particle size within a range of from 0.1 to 10 μm. Preferred are those having a particle size within a range of from 0.3 to 5 μm.

As the inorganic fine particles, fine particles of colloidal silica or titanium dioxide may be mentioned. When a transparent recording medium is to be formed, fine particles of colloidal silica are preferred. When an opaque recording medium is to be prepared, fine particles of titanium dioxide are particularly preferred. It is common to employ colloidal silica fine particles having a particle size within a range of from 10 to 100 nm, preferably from 20 to 50 nm. Likewise, it is common to employ titanium dioxide fine particles having a particle size within a range of from 0.1 to 10 μm, preferably from 0.3 to 5 μm. Such fine particles are preferably used in an amount of from 10 to 70% by weight, based on the total weight of the coating layer.

Further, it is preferred to add an acrylate resin to the coating layer.

The acrylate resin useful for the present invention includes, in addition to a resin obtained by homopolymerizing or copolymerizing (meth)acrylic acid or a (meth)acrylate such as ammonium (meth)acrylate or an amine salt of (meth)acrylic acid by a usual polymerization method, those obtained by copolymerizing such monomer with a monomer such as an alkyl (meth)acrylate such as methyl (meth)acrylate, ethyl (meth)acrylate, butyl (meth)acrylate or hydroxyethyl acrylate, styrene, maleic acid, or methylolacrylamide, by a suitable conventional polymerization method, which have a molecular weight of from 5,000 to 200,000 and which are soluble or uniformly dispersible in water. Particularly preferred are those which are uniformly dispersed in water. Further, such acrylate resin may be used in the form of an aqueous solution or an aqueous emulsion.

The acrylate resin is added preferably in an amount of from 1 to 20% by weight based on the total weight of the coating layer.

As such an acrylate resin, a commercial product sold under the tradename of Voncoat by Dainippon Ink and Chemicals Inc., which is readily available on the market, may be employed.

According to the present invention, polyvinylacetal resin may be used together with such acrylic resin. Such polyvinylacetal resin is produced by reacting polyvinyl alcohol with aldehydes by conventional methods. Polyvinyl alcohol has a polymerization degree of 300 to 4,500, preferably 500 to 4,500 and has a saponification rate of 80.0 to 99.5 mol %.

As aldehyde to be reacted with polyvinyl alcohol, there may be used an aliphatic aldehyde such as formaldehyde, acetoaldehyde butylaldehyde or octylaldehyde and an aromatic aldehyde such as benzaldehyde, 2-methylbenzaldehyde, 4-methylbenzaldehyde, chlorobenzaldehyde or phenylacetoaldehyde. Among these aldehydes, the aromatic aldehyde is preferred.

The ratio of acetal of polyvinylacetal is generally in a range of 2 to 40 mol %, preferably 3 to 30 mol %.

Polyvinylacetal resin is used in an amount of 0.1 to 40% by weight based on the total weight of the dried coating layer.

The coating layer of the recording medium of the present invention may contain a polycarboxylate surfactant and an nonionic fluorinated surfactant. The polycarboxylate surfactant may be the one obtained by neutralizing a polymer of an unsaturated carboxylic acid such as acrylic acid or maleic acid, or a copolymer of such a carboxylic acid with vinyl acetate, vinyl chloride, acrylonitrile, acrylamide or isobutylene, etc. with an alkali metal such as sodium or potassium, or with a base such as ammonia, mono-, di- or tri-ethanolamine, dimethylamine or trimethylamine. The molecular weight is usually from 1,000 to 10,000. As such a polycarboxylate surfactant, the following products are sold and readily available on the market:

Demol EP (tradename, manufactured by Kao Corporation)

Disrol H12 (tradename, manufactured by Nippon Nyukazai K. K.)

Polystar A1060, Polystar OM (tradename, manufactured Nippon Oil and Fat Co., Ltd.)

Such a polycarboxylate surfactant is added in an amount of from 0.1 to 3% by weight, preferably from 0.2 to 1.5% by weight, based on the total weight of the coating layer.

The nonionic fluorinated surfactant may preferably be a perfluoroalkyl polyoxyethylene ethanol, an N-alkyl-N-hydroxypolyethyleneoxy perfluoroalkyl sulfonic acid amide, a fluorinated alkylphosphate, a fluorinated alkylcarboxylate or an N-phosphate or carboxylate-fluorinated alkylsulfonic acid amide.

Specifically, the following products are sold and readily available on the market:

Fluorad FC-170C, Fluorad FC-430 (tradenames, manufactured by 3M Company),

Surflon S (tradename, manufactured by Asahi Glass Co., Ltd.)

Such a nonionic fluorinated surfactant is added in an amount of from 0.1 to 3% by weight, preferably from 0.2 to 1.5% by weight, based on the total weight of the coating layer.

As a coating solvent used for forming the coating layer on the substrate, water is mainly used, and it may further contain a lower alcohol such as isopropyl alcohol or a lower alkyl ketone such as methyl ethyl ketone.

The coating layer formed on the substrate as an ink-receiving layer, preferably has a dried layer thickness of from 1 to 100 μm, more preferably from 4 to 50 μm. If the coating layer is too thin, drying of the ink will be so slow that it is not practically useful. On the other hand, if the coating layer is too thick, the costs per sheet increase, and the coating tends to be difficult.

To form the coating layer on the substrate, the coating solution may be coated directly on the substrate. However, when the adhesion of the formed coating layer to the substrate is inadequate, it is preferred to apply a primer on the substrate prior to the formation of the coating layer. For the formation of the coating layer on the substrate, a usual coating means may be employed such as gravier coating, bar coating, reverse roll coating or knife coating. In the present invention, the coating layer may be formed on one side only or both sides of the substrate.

The recording medium of the present invention is a recording medium for conducting high density recording on the substrate by an ink jet printer and is excellent in the printing properties and quick drying properties of ink after recording.

Further, the recording medium of the present invention is useful not only for observation of the images recorded on the surface but also as a recording medium to be used for an optical device such as a slide projector, OHP or a contact printer wherein a transmitting light through the recorded images is utilized, since the medium is excellent in the light transmittance.

Now, the recording medium of the present invention will be described in further detail with reference to Examples. However, it should be understood that the present invention is by no means restricted by such specific Examples.

EXAMPLE 1

Preparation of a coating solution

| | |
|---|---|
| Hydran HW-310 (tradename for polyester ionomer-type hydrophilic urethane resin, resin solid content: 30%, manufactured by Dainippon Ink and Chemicals Inc.) | 50 parts by weight |
| Urea-formalin resin (particle size: 0.1–3 μm, manufactured by Ciba-Geigy Co.) | 12 parts by weight |

A mixture having the above composition was treated for dispersion for 30 minutes by a homogenizer to obtain a coating solution.

Preparation of recording medium

The above coating solution was coated on a polyvinyl chloride film having a thickness of 200 μm as the substrate by a bar coater method so that the dried layer thickness would be 10 μm and then dried at 80° C. for 10 minutes to obtain a recording medium of the present invention.

To this recording medium, ink jet recording was conducted by means of ink jet printer IO - 720 (manufactured by Sharp Corporation) of the type wherein ink is jetted by a piezo-oscillator, to obtain a recorded image.

The recorded image thus obtained was tested for the following two items to evaluate the recording properties of the recording medium.

(1) Quick drying properties

After the ink jet recording, the recorded medium was left to stand at room temperature. Sixty seconds later, the recorded portion was touched with a finger, whereby the ink did not transfer to the finger and was found to be sufficiently dried.

(2) Quality of the image

The obtained image was free from spreading or running of ink and had a high degree of resolution.

EXAMPLE 2

Preparation of coating solution

| | |
|---|---|
| Hydran AP-30 (tradename for polyester ionomer-type hydrophilic urethane resin, resin solid content: 30%, manufactured by Dainippon Ink and Chemicals Inc.) | 50 parts by weight |
| Colloidal silica (particle size: 10–100 nm, manufactured by Nissan Chemical Industries Ltd.) | 20 parts by weight |

A mixture having the above composition was treated in the same manner except for dispersion for 10 minutes as in Example 1 to obtain a coating solution.

Preparation of recording medium

The coating solution thus prepared was coated on a polyethylene terephthalate film having a thickness of 100 μm by a bar coater method so that the dried layer thickness would be 5 μm and dried in the same manner as in Example 1. The recorded image was formed and evaluated in the same manner as in Example 1, whereby good results were obtained with respect to the above identified items (1) and (2).

Further, the recorded image was projected on a screen by OHP and evaluated by visual observation, whereby the non-recorded portion was bright, and OD (optical density) of the recorded image was high. A projected image having a high contrast which was clear and easy to see, was obtained.

EXAMPLE 3

Preparation of coating solution

| | |
|---|---|
| Urea-formalin resin (particle size: 0.1–3 μm, manufactured by Ciba-Geigy Co.) | 11.3 parts by weight |
| Hydran HW-310 (tradename for polyester ionomer-type hydrophilic urethane resin, manufactured by Dainippon Ink and Chemicals Inc.) | 37.5 parts by weight |
| Demol EP (tradename for polycarboxylate surfactant, manufactured by Kao Corporation) | 0.1 part by weight |
| Fluorad FC-430 (tradename for fluorinated nonionic surfactant, manufactured by 3M Co.) | 0.1 part by weight |
| Water | rest |
| Total | 100 parts by weight |

A mixture having the above composition was treated in the same manner as in Example 1 to obtain a coating solution. The viscosity of the coating solution was 65 cps, and the surface tension was 26 dyn/cm.

Preparation of recording medium

The above coating solution was coated on the same substrate as in Example 1 to obtain a recording medium of the present invention. The coating layer constituting an ink receiving layer was smooth and flat over the entire surface and free from defects such as irregularities in the form of streak lines or craters.

To this recording medium, recording was conducted in the same manner as in Example 1, whereby good results were obtained with respect to the above identified items (1) and (2).

EXAMPLE 4

Preparation of coating solution

| | |
|---|---|
| Colloidal silica, manufactured by Nissan Chemical Industries Ltd.) | 30 parts by weight |
| Hydran AP-310 (tradename for polyester ionomer-type hydrophilic urethane resin, manufactured by Dainippon Ink and Chemicals Inc.) | 50 parts by weight |
| Disrol H-12 (tradename, manufactured by Nippon Nyukazai K.K.) | 0.35 part by weight |
| Fluorad FC-170C (tradename, manufactured by 3M Co.) | 0.45 part by weight |
| Water | rest |
| Total | 100 parts by weight |

A mixture having the above composition was treated for dispersion for 20 minutes by a homogenizer to obtain a coating solution. The viscosity of the coating solution was 100 cps, and the surface tension was 21 dyn/cm.

Preparation for recording medium

The above coating solution was coated on a polyethylene terephthalate film having a thickness of 75 μm as the substrate by a die coater method so that the dried layer thickness would be 10 μm and dried in the same manner as in Example 1. The recorded image was formed and evaluated in the same manner as in Example 1, whereby good results were obtained with respect to the above identified items (1) and (2).

Further, the recorded image was projected on a screen by OHP and evaluated by visual observation, whereby the non-recorded portion was bright, and OD (optical density) of the recorded image was high. Thus, a projected image having a high contrast, which was clear and easy to see, was obtained.

EXAMPLE 5

Preparation of a coating solution

| | |
|---|---|
| Hydran HW-310 (tradename for polyester ionomer-type hydrophilic urethane resin, resin solid content: 30%, manufactured by Dainippon Ink and Chemicals Inc.) | 50 parts by weight |
| Voncoat V (tradename for acrylate resin, resin solid content: 30%, manufactured by Dainippon Ink and Chemicals Inc.) | 2.5 parts by weight |
| Demol EP (tradename for polycarboxylate surfactant, manufactured by Kao Corporation) | 0.1 part by weight |
| Fluorad FC-170 (tradename for fluorinated nonionic surfactant, manufactured by 3M Co.) | 0.1 part by weight |
| Urea-foraldehyde resin (Particle size: 0.1–3 μm, manufactured by Ciba-Geiby Co.) | 12 parts by weight |

A mixture having the above composition was treated in the same manner as in Example 1 to obtain a coating solution.

Preparation of recording medium

A recording medium of the present invention was obtained in the same manner as in Example 1 by using the above coating solution. To the recording medium thus obtained, recording was conducted in the same manner as in Example 1, and the recording properties were inspected with respect to the above identified items (1) and (2), whereby the results were good.

EXAMPLE 6

Preparation of coating solution

| | |
|---|---|
| Hydran AP-30 (tradename for polyester ionomer-type hydrophilic urethane resin, resin solid content: 30%, manufactured by Dainippon Ink and Chemicals Inc.) | 50 parts by weight |
| Voncoat 398 5 (tradename for acrylate resin, resin solid content: 30%, manufactured by Dainippon Ink and Chemicals Inc.) | 5 parts by weight |
| Colloidal silica (particle size: 10–100 nm, manufactured by Nissan Chemical Industries Ltd.) | 20 parts by weight |

A mixture having the above composition was treated in the same manner as in Example 1 to obtain a coating solution.

Preparation of recording medium

A recording medium was prepared in the same manner as in Example 2 by using the above coating solution. To the recording medium thus obtained, recording was conducted in the same manner as in Example 1, and the recorded image was evaluated with respect to the above identified items (1) and (2), whereby the results were good.

Further, the recorded image was projected on a screen by OHP and evaluated by visual observation, whereby the non-recorded portion was bright, and OD (optical density) of the recorded image was high. A projected image having a high contrast, which was clear and easy to see, was obtained.

EXAMPLE 7

Preparation of a coating solution

| | |
|---|---|
| Hydran HW-310 (tradename for polyester ionomer-type hydrophilic urethane resin, resin solid content: 30%, manufactured by Dainippon Ink and Chemicals Inc.) | 45 parts by weight |
| Voncoat V (tradename for acrylate resin, resin solid content: 30%, manufactured by Dainippon Ink and Chemicals Inc.) | 2.5 parts by weight |
| S-lec W-201 (tradename for polyvinylacetal resin, resin solid content: 25%, manufactured by Sekisui Chemical Co., Ltd.) | 5 parts by weight |
| Demol EP (tradename for polycarboxylate surfactant, manufactured by Kao Corporation) | 0.1 part by weight |
| Fluorad FC-170 (tradename for fluorinated nonionic surfactant, manufactured by 3M Co.) | 0.1 part by weight |
| Urea-foraldehyde resin (Particle size: 0.1–3 μm, manufactured by Ciba Geiby Co.) | 12 parts by weight |

A mixture having the above composition was treated in the same manner as in Example 1 to obtain a coating solution.

Preparation of recording medium

A recording medium of the present invention was obtained in the same manner as in Example 1 except for recording by the ink jet printer IO-730 (manufactured by Sharp Corporation) and using the above coating solution. To the recording medium thus obtained, recording was conducted in the same manner as in Example 1, and the recording properties were inspected with respect to the above identified items (1) and (2), whereby the results were good.

What is claimed is:

1. A recording medium consisting essentially of a non-porous substrate and a single coating layer formed on at least one side thereon, said coating layer comprising a carboxyl group-containing ionomer hydrophilic urethane resin and organic fine particles, inorganic fine particles or mixtures thereof.

2. The recording medium according to claim 1, wherein the ionomer-type hydrophilic urethane resin has a molecular weight within a range of from 1,000 to 100,000.

3. The recording medium according to claim 1, wherein the ionomer-type hydrophilic urethane resin is a polyester urethane resin.

4. The recording medium according to claim 3, wherein the ionomer-type hydrophilic urethane resin is a resin obtained by reacting an isocyanate to an ester of a dicarboxylic acid with a diol.

5. The recording medium according to claim 4, wherein the dicarboxylic acid is a saturated or unsaturated aliphatic dicarboxylic acid.

6. The recording medium according to claim 4, wherein the dicarboxylic acid is an aromatic dicarboxylic acid.

7. The recording medium according to claim 5, wherein the dicarboxylic acid is adipic acid.

8. The recording medium according to claim 5, wherein the dicarboxylic acid is maleic acid.

9. The recording medium according to claim 6, wherein the dicarboxylic acid is terephthalic acid.

10. The recording medium according to claim 4, wherein the diol is at least one glycol selected from the group consisting of alkylene glycols, polyalkylene glycols, alkyleneoxide adducts of bisphenol A and aliphatic carboxylic acids having two hydroxyl groups per molecule.

11. The recording medium according to claim 10, wherein the diol is at least one member selected from the group consisting of ethylene glycol, propylene glycol, butanediol, hexanediol, triethylene glycol, polyethylene glycol, polypropylene glycol and dimethylol propionic acid.

12. The recording medium according to claim 4, wherein the ionomer-type hydrophilic urethane resin is a resin obtained by reacting an alicyclic diisocyanate to an ester of a saturated aliphatic dicarboxylic acid with at least one aliphatic diol.

13. The recording medium according to claim 12, wherein the ionomer-type hydrophilic urethane resin is a resin obtained by reacting isophorone diisocyanate to an ester of adipic acid with 1,6-hexanediol and dimethylol propionic acid.

14. The recording medium according to claim 1, wherein the ionomer-type hydrophilic urethane resin is a polyether urethane resin.

15. The recording medium according to claim 14, wherein the ionomer-type hydrophilic urethane resin is a resin which is a reaction products of an isocyanate, a polyether diol and an aliphatic monocarboxylic acid having two hydroxyl groups per molecule.

16. The recording medium according to claim 15, wherein the polyether diol is a polyalkylene glycol.

17. The recording medium according to claim 16, wherein the polyalkylene glycol has a molecular weight within a range of from 200 to 4,000.

18. The recording medium according to claim 16, wherein the polyether diol is polyethylene glycol or polypropylene glycol.

19. The recording medium according to claim 15, wherein the aliphatic monocarboxylic acid is dimethylol propionic acid.

20. The recording medium according to claim 4 or 15, wherein the isocyanate is a chain-structured or cyclic aliphatic isocyanate.

21. The recording medium according to claim 20, wherein the isocyanate is hexamethylene diisocyanate.

22. The recording medium according to claim 26, wherein the isocyanate is isophorone diisocyanate.

23. The recording medium according to claim 4 or 15, wherein the isocyanate is an aromatic diisocyanate.

24. The recording medium according to claim 23, wherein the isocyanate is at least one member selected from the group consisting of diphenylmethane diisocyanate, xylene diisocyanate and 2,4- and 2,6-tolylene diisocyanate.

25. The recording medium according to claim 1, wherein the particle size of the organic fine particles is within a range of from 0.1 to 10 μm.

26. The recording medium according to claim 25, wherein the organic fine particles are fine particles of a urea-formaldehyde resin.

27. The recording medium according to claim 1, wherein the inorganic fine particles are colloidal silica having a particle size of from 10 to 100 nm.

28. The recording medium according to claim 1, wherein the inorganic fine particles ar fine particles of titanium dioxide having a particle size of from 0.1 to 10 μm.

29. The recording medium according to claim 1, wherein the non-porous substrate is a plastic film or sheet.

30. The recording medium according to claim 1, wherein the non-porous substrate is a sheet of polyvinyl chloride or polyester.

31. The recording medium according to claim 1, wherein the coating layer is a layer containing an ionomer-type hydrophilic urethane resin, an acrylate resin and organic and/or inorganic fine particles.

32. The recording medium according to claim 31, wherein the acrylate resin is a polymer of a (meth)acrylate.

33. The recording medium according to claim 31, wherein the acrylate resin is present in an amount of from 1 to 20% by weight, based on the total weight of the coating layer.

34. The recording medium according to claim 1, wherein the acrylate resin has a weight average molecular weight within a range of from 5,000 to 200,000.

35. The recording medium according to claim 1, wherein the coating layer further comprises a polycarboxylate surfactant and a nonionic fluorinated surfactant.

36. The recording medium according to claim 35, wherein the polycarboxylate surfactant is a polymer of an unsaturated carboxylic acid or a surfactant obtained by neutralizing with a base, or a copolymer of an unsaturated carboxylic acid with a compound having a vinyl group.

37. The recording medium according to claim 36, wherein the polycarboxylate surfactant is a polymer of acrylic acid or maleic acid, or a surfactant obtained by neutralizing with an alkali metal, ammonia, a mono-, dior tri-ethanolamine, dimethylamine or trimethylamine, a copolymer of acrylic acid or maleic acid with vinyl acetate, vinyl chloride, acrylonitrile, acrylamide or isobutylene.

38. The recording medium according to claim 37, wherein the polycarboxylate surfactant has a weight average molecular weight of from 1,000 to 10,000.

39. The recording medium according to claim 35, wherein the nonionic fluorinated surfactant is selected from the group consisting of a perfluoroalkylpolyoxyethylene ethanol, an N-alkyl-N-hydroxyethyleneoxyperfluoroalkyl sulfonic acid amide, a fluorinated alkyl phosphate or carboxylate, and an N-phosphate or carboxylate-fluorinated alkyl sulfonic acid amide.

40. The recording medium according to claim 35, wherein the polycarboxylate surfactant and the fluorinated nonionic surfactant are present in a total amount of from 0.2 to 1.5% by weight, based on the total weight of the coating layer.

41. The recording medium according to claim 1, wherein the ionomer-type hydrophilic urethane resin is present in an amount of from 40 to 60% by weight, based on the total weight of the coating layer.

42. The recording medium according to claim 1, wherein the inorganic and/or organic fine particles are present in an amount of from 10 to 70% by weight, based on the total weight of the coating layer.

* * * * *